United States Patent [19]

Schmidtke

[11] Patent Number: 4,596,210

[45] Date of Patent: Jun. 24, 1986

[54] METHOD AND DEVICE FOR DISSOLVING GAS, ESPECIALLY CARBON DIOXIDE, IN LIQUID FUEL AND FOR DISTRIBUTING THE FUEL IN A SUPERSATURATED STATE THROUGH THE COMBUSTION AIR

[75] Inventor: Wolfgang Schmidtke, Paderborn, Fed. Rep. of Germany

[73] Assignee: Kohlensaurewerke C. G. Rommenholler GmbH, Bad Driburg-Herste, Fed. Rep. of Germany

[21] Appl. No.: 605,030

[22] PCT Filed: Aug. 31, 1983

[86] PCT No.: PCT/EP83/00228

§ 371 Date: Apr. 25, 1984

§ 102(e) Date: Apr. 25, 1984

[87] PCT Pub. No.: WO84/00996

PCT Pub. Date: Mar. 15, 1984

[51] Int. Cl.[4] ..... F02B 75/12

[52] U.S. Cl. ..... 123/1 A; 123/3; 123/531

[58] Field of Search ..... 123/1 A, 3, 575, 576, 123/522, 523, 531; 48/189.4; 261/DIG. 83, 76, 78 R

[56] References Cited

U.S. PATENT DOCUMENTS

| | | | |
|---|---|---|---|
| 1,465,574 | 8/1923 | Bannister | 123/523 |
| 2,114,548 | 4/1938 | Stadlman | 123/531 |
| 2,745,251 | 5/1956 | Schirmer | 123/531 |
| 4,011,847 | 3/1977 | Fortino | 261/DIG. 83 |
| 4,273,560 | 6/1981 | Kostka | 123/3 |
| 4,336,783 | 6/1982 | Henson | 261/DIG. 83 |
| 4,343,282 | 8/1982 | Glenn | 123/523 |
| 4,362,137 | 12/1982 | O'Hare | 123/3 |
| 4,429,674 | 2/1984 | Lübbing | 123/531 |
| 4,483,307 | 11/1984 | Gilmor | 261/DIG. 83 |

OTHER PUBLICATIONS

Bak "Liquid Petroleum Gasifier Replaces Carburetor", 3/1981, *New Design Ideas.*

*Primary Examiner*—E. Rollins Cross

*Attorney, Agent, or Firm*—Sprung Horn Kramer & Woods

[57] ABSTRACT

Method and device for dissolving gas, especially carbon dioxide or compressed air, in liquid subject to conditions of pressure and temperature at which, when the solution is subsequently introduced into the combustion air, it will be in a supersaturated state and accordingly finely disperses and distributes itself uniformly. The fuel is forced by a pump (41) into the mixer (11), to which the gas is supplied through a flow regulator (29). Downstream of the mixer (11) are a turbulent section (163), a mixing dome (161), and an exhaust section (164) from which the solution is supplied free of bubbles to the carburetor or injector of an internal-combustion engine, a heating burner, or a reaction-engine burner. The flow regulator (29) is controlled in accordance with the throughput of fuel and regulated by a regulation device (R) in accordance with the percentage of gas in the mixing dome (161) as determined by a pressure gauge (46) or light sensor (51).

14 Claims, 7 Drawing Figures

Figure 1:
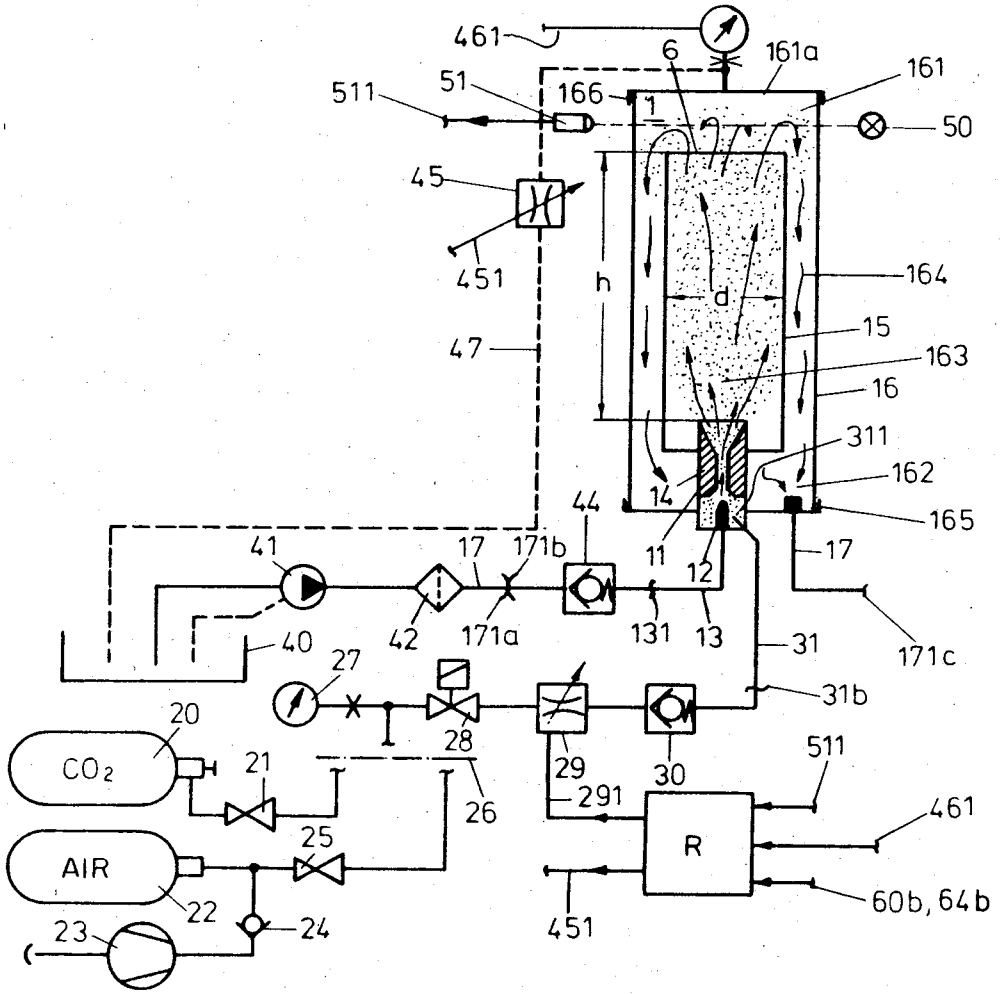

METHOD AND DEVICE FOR DISSOLVING GAS, ESPECIALLY CARBON DIOXIDE, IN LIQUID FUEL AND FOR DISTRIBUTING THE FUEL IN A SUPERSATURATED STATE THROUGH THE COMBUSTION AIR

The invention relates to a method of distributing liquid fuel in combustion air that the fuel is mixed into through a carburetor or injector.

It is known that liquids that have gases dissolved in them will spontaneously release the dissolved gas and foam up or, when simultaneously atomized, break down into fine droplets when the ambient pressure drops suddenly or the temperature increases rapidly leading to a state of supersaturation because of the lower solubility of the gases at lower pressure or higher temperature.

Distributing liquid fuels in combustion air by atomization and partial evaporation through heating and turbulence is on the other hand also known. These mixing procedures all apply downstream of what is called the carburetor or the injector nozzles in that they are intended to employ zones of turbulence and a special design and disposition of the combustion or explosion space to supply the fuel or mixture of fuel and air. Since none of these measures, however, are sufficient to attain a completely uniform and very fine distribution of fuel, some of the fuel leaves the combustion space uncombusted or separated in the form of carbon monoxide or carbon or else, when an excess of air is supplied, the excess is fruitlessly consumed to form nitrogen monoxides and injurious exhaust is released.

The object of the present invention is to disclose a method and a device for distributing fuel in combustion air essentially more uniformly and finely, diminishing the drawbacks of the known methods and achieving improved combustion at higher efficiency, less injurious exhausts, reliable sparking, and hence fewer problems in starting engines and a lower tendency for engines to knock.

This object is attained in accordance with the invention in that gas, preferably air and/or carbon dioxide is dissolved in the fuel, at a state of dissolution pressure and temperature at which a higher gas solubility of the gas is ensured than at the state of mixing pressure and temperature of the combustion air during admixture, in a quantitative ratio such that the saturation-quantity ratio is exceeded at the state of mixing pressure and temperature and the solution supplied to the carburator or injector.

The method can be employed for both explosive and continuous combustion systems. Various solutions of gas and fuel can be employed depending on the application.

When employed in connection with partial-vacuum carburetors, for instance, it is practical to dissolve a gas of high solubility, carbon dioxide for example, in the gasoline.

It is furthermore practical to employ hydrogen, especially as a sparking aid, when burning difficult-to-burn liquids like diesel oil or heavy oil.

When burning fuels with a relatively high carbon content, benzene for example, the dissolution of oxygen is practical.

Minimum supply-technology expenditure is ensured by using compressed air generated on site by a relatively small compressor. Enough air for the intended purposed can in particular be dissolved if the fuel is saturated subject to a pressure of several atmospheres.

A switchover or mixing operation with various gases, carbon dioxide for example when starting or at low temperatures and air for continuous operation, yields a practical combination with respect to the technical action and economics of the material input. The introduction of carbon dioxide can be relatively increased even when operation conditions are aggravated, so that a tendency to knock develops.

The device for dissolving the gas is a closed unit that is always simple to introduce into the fuel line. In one practical embodiment the device is controlled subject to internally obtained criteria with respect to fuel flow and the resulting saturation.

When the flow oscillates widely, in engines for example, the existing control criterion of the fuel-flow regulator is exploited in a practical way to control the device for saturation.

A device for carrying out the method and how it can be installed in known internal-combustion engines and systems is illustrated in FIGS. 1 through 7.

Figure 3:
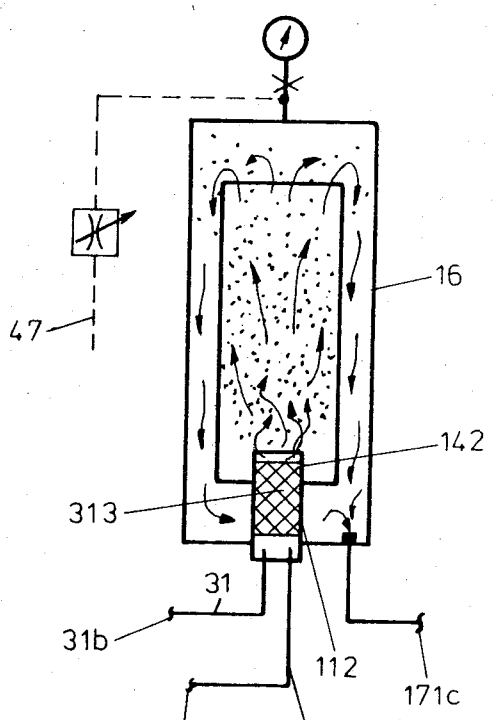
Figure 2:
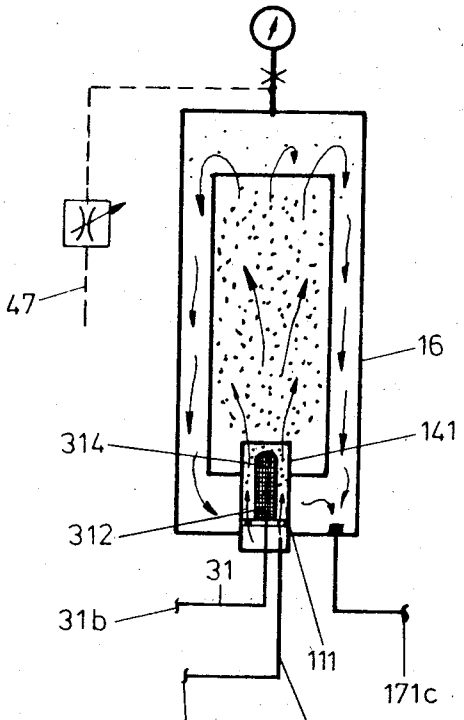
Figure 5:
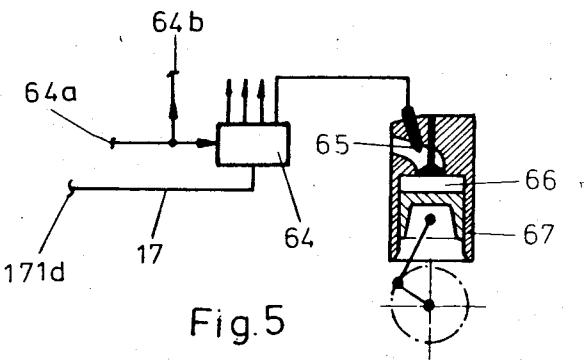
Figure 7:
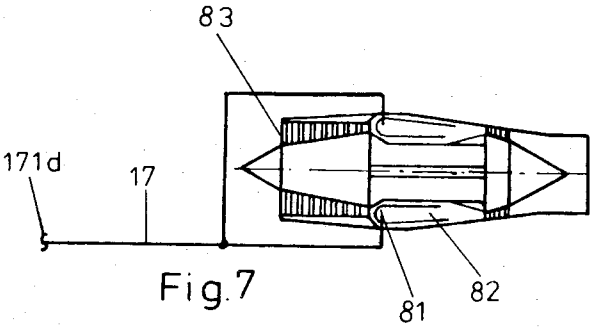
Figure 4:
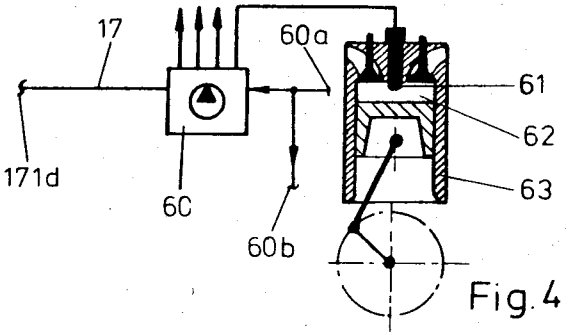
Figure 6:
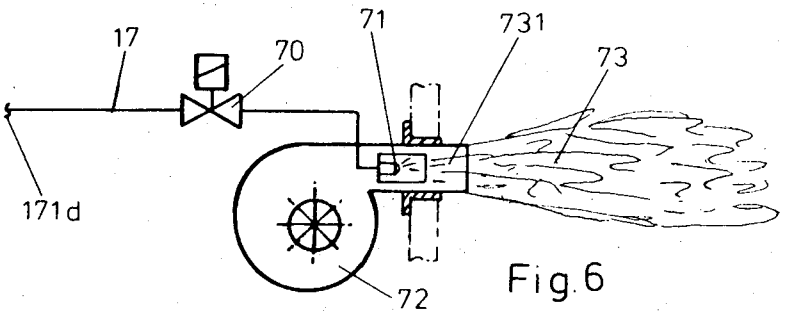

FIG. 1 is a schematic representation of a device for dissolving gases in fuel, FIG. 2 illustrates an alternative mixer for the device in FIG. 1, FIG. 3 illustrates another mixer for the device in FIG. 1, FIG. 4 illustrates how the device in FIG. 1 can be connected to a diesel engine, FIG. 5 illustrates how the device in FIG. 1 can be connected to an injection engine, FIG. 6 illustrates how the device in FIG. 1 can be connected to a heating burner, and FIG. 7 illustrates how the device in FIG. 1 can be connected to a reaction engine.

The device for dissolving gases in fuels illustrated in FIG. 1 consists of an injector-mixer 11 with a nozzle 12 to which fuel is supplied over a line 13. Nozzle 12 is surrounded by a mixing chamber 311 into which the gas, compressed air or carbon dioxide in this case, is supplied over a line 31. An upright cylindrical pipe 15 in which the bubbles of gas dissolve in the fuel in a turbulent section 163 is connected to injector-mixer 11. Pipe 15 is dimensioned in a practical way such that the height h of turbulent section 163 is approximately twice the diameter d so that the bubbles of gas will be practically completely dissolved during maximum fuel throughput when they arrive at the top. Undissolved gas accumulates in a mixing dome 161 above the top of pipe 15. A housing 16 extends down concentric with pipe 15 from mixing dome 161. The diameter of housing 16 is such that at maximum throughput the falling speed of the fuel is lower in an exhaust section 164 between housing 16 and pipe 15 than the rising speed of any residual gas bubbles still present. A fuel line 17 is connected to the bottom of housing 16 and leads to what is called the carburetor or injection devices.

Housing 16 is made out of glass or at least partly out of glass to allow optimum monitoring of the correct flow regulation of the amount of gas employed.

The fuel is conveyed from a tank 40 through a filter 42 by means of a pump 41 in a known way and under pressure along fuel line 17.

Between a connection 171*a*, which is connected to connections 171*b* and 171*c* and to which in known engines and combustion systems is connected to a connection 171*d* (FIGS. 4–7), and, the device is furnished with a check valve 44 built into lines 17 and 13 in a practical way to maintain constant pressure in housing 16 in order to maintain the saturation state of the fuel.

Carbon dioxide is supplied to a mixing line 26 from a pressure tank 20 over a reduction valve 21 and a reservoir 22 on the other hand filled with compressed air by a compressor 23, the air also being supplied to mixing line 26 through a reduction valve 25. A compressed-air system of this type is already present in, for example, trucks. Because of the relatively small need for air, it is sufficient in an automobile to charge a reservoir with a compressor when fuel is purchased or a small separate compressor can be provided.

A manometer 27 monitors the pressure in mixing line 26. A valve 28 opens, subject to an operating signal, mixing line 26 to a flow regulator 29, from which a line 31 leads to a injector-mixer 11 over a check valve 30. The function of these components can also be integrated into special subassemblies depending on their design. Thus, when flow regulator 29 is firmly closed in the non-operating state, there is no need for a separate valve 28. Furthermore, reservoir 22 can be left out when a special, constantly following, compressor 23 is provided. To the extent that this compressor can be controlled it can also assume the function of flow regulator 29.

When a constant flow of fuel is necessary, as in heating burners for instance, the flow regulator can be set once, by observing the dissolution of the bubbles before arriving at mixing dome 161 for example. Monitoring can however also be carried out with a pressure gauge 46 or gas-bubble sensor like a float or, as illustrated, a light barrier 50, 51, which also affords the possibility of controlling flow regulation automatically. In so doing, signal line 461 or 511 is supplied to a regulation device R and the signal compared with a predetermined value that corresponds to the presence of a lower flow of bubbles as compared with the flow at the output of injector-mixer 11 and controlled by a differential signal from flow regulator 29 over a line 291.

When fuel consumption varies considerably it is an advantage to provide a return line 47 from mixing dome 161 to tank 40 through another flow regulator 45. Flow regulator 45 is opened when a gas bubble that is large in relation to normal operation has accumulated in mixing dome 161, as results from comparison of the signal from light barrier 50 and 51 with an accordingly high reference value by automatic regulation over line 451.

The flow of quantities of gas can also be controlled depending on fuel throughput by means of a given flow-regulation signal to the input lines **60*b*, 64*b*** of regulation device R to which the aforesaid differential signal relating to deviations from regulation is supplied additively when a control is also supplied.

Since it takes the gas bubbles a certain amount of time to travel through turbulent section 163 it is necessary, in order to avoid fluctuations in control, to provide a matching delay in the device that controls the setting signals.

When fuel demand is high it is practical because of considerations of overall height to accommodate several mixers 11 with pipes 15 in parallel in one housing 16 or to provide other mixers instead of nozzle 12.

FIG. 2 illustrates an alternative embodiment of mixer 11 with a sintered candle 314. The gas enters mixing chamber 312 in fine bubbles through the pores in the candle. The candle can also lie flat on the floor of pipe 15 with the fuel entering laterally.

FIG. 3 illustrates another embodiment of a mixer 112 that consists of a known static mixer with a mixing chamber 313 that the gas and fuel is supplied to.

The particular type of mixer 11, 111, or 112 to be selected depends practically on the combination of gas and fuel selected and on their properties, especially with respect to contamination or blockage of the pores or nozzle. Another criterion, if the throughputs ever vary to a considerable extent, is miscibility.

The connections in the devices illustrated in FIGS. 2 and 3 are similar to those in FIG. 1.

The gases are generally dissolved subject to an initial pressure of about two atmospheres, higher pressures being preferred. When, however, what is called the carburetor of a carburetor engine, which can not be subjected to partial vacuum, is positioned downstream of the device, a readily soluble gas like carbon dioxide must be employed for saturation. In this case, partial vacuum will produce a state of supersaturation in what is called a carburation process and will lead to a finer distribution of the fuel and, when the mixture of fuel and air is subsequently heated by heating from the cylinder wall, more gas will be released accompanied by the droplets breaking up.

FIG. 4 illustrates how the device can be employed in a diesel engine 63. A solution of diesel oil and air or carbon dioxide is saturated at about 10 atmospheres and conveyed to an injector pump 60, whence it arrives in a combustion chamber 62 through an injector nozzle 61.

Since the compressed air, which is also heated by the cylinder wall in certain cases, has a high temperature, the solubility of the gas will be exceeded in spite of the high pressure, and the solution will be finely atomized by the emerging gas. This significantly improves the cold-starting properties in particular, so that saturation with the readily dissolving carbon dioxide is to be recommended for starting. When the engine is warm, saturation with air is adequate for improved efficiency and reducing the destructive exhausts and soot formation.

Valves 21 and 25 are reversed in accordance with motor temperature for carbon dioxide and compressed air in a practical way.

The flow of gas is regulated, meaning that flow regulator 29 is controlled, when a control signal from regulation device R is supplied over a signal line **60*b* from a flow-regulation control line 60*a* to injector pump 60 or to flow regulator 29** directly.

FIG. 5 illustrates an injection engine 67. The saturated solution is supplied to its fuel-flow divider 64 and thence conveyed to an injector nozzle 65. Since the combustion air that is simultaneously suctioned up has a considerably lower pressure than the solution, a spontaneous atomization of the solution by the gas that is being freed ensues, which improves not only combustion but also the cold-starting properties. The ratio of the mixture of fuel and combustion air can accordingly be established for a much lower excess of air than in known motors of this type, which leads to further increase in efficiency and decrease emission of pollutants.

Dissolving carbon dioxide in the fuel increases the knock resistance of the solution above that of pure fuel. This is another practical effect.

The signal that controls flow regulator 29 results from the signal that controls the fuel flow divider and that is removed from line **64*a* through line 64*b***.

FIG. 6 illustrates a heating burner with the device for dissolving gas positioned in its fuel line upstream of a controlled valve 70. As soon as the pressurized solution enters the combustion air from burner nozzle 71 the fuel is finely divided by the gas being released and is mixed with the flow of air. This effect is augmented by reverse radiation from a flaming zone 73 into a mixing zone 731 because the heating releases additional gas that separates the droplets even more.

Since the flame burns practically without soot as a result of the fine distribution of the fuel, no soot accumulates on the downstream heat exchanger, further improving the efficiency of the heating plant in relation to known systems.

The method is appropriate for both heating oil and heavy oil and for a mixture of fuel and contaminants. The flammability of the solution can be further improved if a combustible gas like hydrogen, natural gas, or propane is dissolved in the fuel.

Since the flow of fuel is constant, the flow regulation of the amount of gas is fixed, leading to a very simple device.

FIG. 7 illustrates a reaction engine 83 with the device for dissolving gas introduced into its fuel line. Since the delivery pressure of nozzles 81 is relatively high, a large amount of gas can be dissolved in the fuel and the distribution of the fuel while it remains in mixing zone 81 considerably improved. Contributing to this also is the heat radiation emerging from a flaming zone 82 into a mixing zone 81, which subsequently breaks up the droplets of fuel by releasing gas. This results in practically sootless combustion and increases efficiency.

Carbon dioxide, because of its high solubility, and a combustible gas, because of its satisfactory flammability that extensively prevents the propulsion unit from misfiring, are especially appropriate for saturating the fuel.

A control signal is also supplied from the fuel regulator to regulation device R to regulate the flow of gas in this system as well. When combustible gases or gases with a high percentage of oxygen are employed, the known safety-design measures must be taken into account. In these cases, it is practical if the turbulent section 163 is large enough to eliminate conveying gas off through a flow regulator 45.

Systems in accordance with the invention that are employed in the situations illustrated or in similar cases can be optimized by appropriate combinations of the illustrated components or by appropriate combinations of fuel and gas selected by one skilled in the art. The devices for dissolving gas in fuel can be replaced by other equivalents to the extent that they satisfy the demands of the solutions in accordance with the method.

The signals that control the flow regulation of the gas and the associated regulating devices can be electronic, mechanical, pneumatic, etc. in accordance with the particular type of device regulating the flow of the fuel. Thus the time pulses that control injection can also be exploited to control the flow regulator when an electromagnetically controlled valve is employed. In another embodiment in which the injector pump is set by means of a rotating shaft, the rotation acts directly or through a cam on a mechanically operated flow regulator. In another embodiment the rotation is converted into an electric signal by a sensor, a potentiometer for example, and supplied to electronic controls or to an electronic regulator.

I claim:

1. In a method of distributing liquid fuel in combustion air at a certain mixing pressure and temperature mixed into it by a carburetor or injector into a combustion chamber or zone, the improvement comprising dissolving a gas from an external source in the fuel to produce a solution external to said combustion chamber or zone, providing a solution temperature at ambient temperature and a solution pressure greater than atmospheric at which a higher gas solubility of the gas is ensured supplying the liquid solution to the carburetor or injector.

2. The method as in claim 1, wherein the solution is completely saturated with the gas at the solution temperature.

3. The method as in claim 1, wherein the solution pressure is several atmospheres above the combustion air mixing pressure and the solution temperature is not greater than the combustion air mixing temperature.

4. The method as in claim 1, further comprising providing the combustion air mixing temperature higher than the solution temperature by adding combustion heat in the form of radiation from the combustion zone or from walls of the combustion chamber and providing the solution pressure and combustion air mixing pressure not greater than normal pressure.

5. The method as in claim 1, further comprising constantly supplying the fuel and the gas regulated in the specified quantitative ratio to a vertically positioned gas/fuel mixer with a turbulent section located above it and with a gas/fuel mixing dome located above the turbulent section, thereafter diverting same into a separating section that is oriented downward and supplying from its bottom the solution to the carburetor or injector, wherein the turbulent section is dimensioned so that the stream of gas bubbles is extensively dissolved before it arrives at the gas/fuel mixing dome and the cross-section of the separating section is dimensioned so that the speed at which the fuel solution falls is lower than that at which the gas bubbles rise.

6. The method as in claim 1, wherein the gas has a property of least one of dissolves readily, burns readily and is oxidizing.

7. The method as in claim 1, wherein the fuel is selected from methyl alcohol, ethyl alcohol, gasoline, benzene, heating oil, diesel oil, heavy oil, and a mixture of fuel and pollutant.

8. A device for mixing liquid fuel in combustion air by feeding the fuel and air to a carburetor or injector at a mixing temperature and pressure, comprising means dissolving gas into the fuel and air at a solution temperature at ambient temperatures and at a solution pressure greater than atmospheric at which a higher gas solubility of the gas is ensured, said means for dissolving said gas in said fuel being external to said carburetor or injector.

9. The device as in claim 8, further comprising a cylindrical pipe containing a turbulent section positioned downstream of a gas/fuel mixer and having a height that is twice its diameter and a cylindrical glass housing is positioned concentric to the pipe to form a separating section with a solution delivery line connected to its lower section.

10. The device as in claim 8, wherein the fuel is supplied from a tank to the dissolving means through a filter and a check valve, and wherein a pump supplies the solution pressure.

11. The device as in claim 8, further comprising means supplying a the gas via line fed by a pressure tank through a reduction valve to deliver the gas at the solution pressure and followed by a flow regulator to the dissolving means.

12. The device as in claim 11, wherein the flow regulator has a control input connected to a regulator connected on its input side with a sensor for indicating the intensity of a stream of bubbles of the gas in the gas/fuel mixing dome and has regulation means for controlling the flow regulator wherein a signal from the sensor is compared with a given reference value and the resulting differential signal is fed as a control signal to the flow regulator.

13. The device as in claim 12, wherein a fuel-return line leading to a tank is positioned at the gas/fuel mixing dome with a flow regulator that is turned on by the control means when the sensor indicates the pressure of a large gas bubble in the mixing dome.

14. Internal-combustion engine comprising the device of claim 10 and wherein the gas is dissolved in the fuel downstream of the pump.

* * * * *

UNITED STATES PATENT AND TRADEMARK OFFICE

CERTIFICATE OF CORRECTION

PATENT NO. : 4,596,210

DATED : June 24, 1986

INVENTOR(S) : Wolfgang Schmidtke

It is certified that error appears in the above-identified patent and that said Letters Patent is hereby corrected as shown below:

Title Page, after "[23]" Insert --[30] FOREIGN APPLICATION PRIORITY DATA 9/4/82 Fed. Rep. of Ger. 32 32 938--

Signed and Sealed this

Tenth Day of February, 1987

*Attest:*

DONALD J. QUIGG

*Attesting Officer*

*Commissioner of Patents and Trademarks*